US007311336B2

(12) United States Patent
Dacey

(10) Patent No.: US 7,311,336 B2
(45) Date of Patent: Dec. 25, 2007

(54) SPINE ASSEMBLY

(75) Inventor: Derek Dacey, Winford (GB)

(73) Assignee: Compass Maps Limited, Bristol (GB)

( * ) Notice: Subject to any disclaimer, the term of this patent is extended or adjusted under 35 U.S.C. 154(b) by 571 days.

(21) Appl. No.: 10/498,270

(22) PCT Filed: Oct. 9, 2002

(86) PCT No.: PCT/GB02/04584

§ 371 (c)(1),
(2), (4) Date: Jun. 8, 2004

(87) PCT Pub. No.: WO03/031197

PCT Pub. Date: Apr. 17, 2003

(65) Prior Publication Data

US 2005/0017499 A1 Jan. 27, 2005

(30) Foreign Application Priority Data

Oct. 10, 2001 (GB) ..... 0124329.4

(51) Int. Cl.
*B42D 1/00* (2006.01)

(52) U.S. Cl. ..... 281/30; 281/31; 281/36; 402/73; 206/450; 206/473

(58) Field of Classification Search ..... 281/30, 281/31, 36; 402/73; 206/473, 450
See application file for complete search history.

(56) References Cited

U.S. PATENT DOCUMENTS 1,848,980 A * 3/1932 Walker ..... 281/15.1
4,517,628 A * 5/1985 McDermott ..... 362/186
D289,530 S * 4/1987 Arrington ..... D19/27
4,680,681 A 7/1987 Fisherman et al.
4,986,572 A * 1/1991 Kuykendall ..... 281/15.1
5,273,319 A * 12/1993 Lee ..... 281/29
5,368,333 A * 11/1994 Arroyo ..... 281/31
5,419,586 A * 5/1995 Golson ..... 283/34
5,573,166 A * 11/1996 Leja ..... 224/630
5,909,897 A * 6/1999 Lu ..... 281/22
6,241,414 B1 * 6/2001 Wien ..... 402/73
6,629,800 B1 * 10/2003 Brown ..... 402/58
2001/0013698 A1 * 8/2001 Soussan ..... 281/15.1

FOREIGN PATENT DOCUMENTS

DE 8709142 8/1987
DE 8709142 U * 8/1987
GB 477546 1/1938
GB 484535 5/1938
WO WO03031197 A1 * 4/2003

* cited by examiner

*Primary Examiner*—Daniel W. Howell
(74) *Attorney, Agent, or Firm*—Carmody & Torrance LLP

(57) ABSTRACT

There is provided a spine assembly for a book cover or loose-leaf folder. The cover or folder comprises a channel shaped spine member (4) connected by way of a hinge portion to cover boards and an associated device, perhaps incorporating a compass (36), having securing means for securing the associated device (30) and the spine member (4). The spine member (4) has a base (10), side wall portions (11, 12) and a pin (20) by which the associated device (30) is secured to the spine member (4).

17 Claims, 4 Drawing Sheets

SPINE ASSEMBLY

CROSS REFERENCE TO RELATED APPLICATIONS

This application is a National Stage application of International Application No. PCT/GB02/04584, filed Oct. 9, 2002.

The present invention relates to the general field of loose-leaf folders, books, book covers and the like and to a spine assembly for a loose-leaf folder, book, book cover and the like. More particularly, but not exclusively, the invention relates to devices of the aforementioned kind when applied to travel information.

Commuters and other travellers habitually carry books with them. Such books may be used to pass the time on the journey or may have an educational or informational content necessary for the users needs.

The applicants have realised that the book itself, or a loose-leaf folder being carried, provides a readily available means for also carrying other devices.

With the increase in long distance travel and long distance holidays there has been growth in the production of guide books and other travel literature. Such literature may be published in the form of a book, which may include a map or maps of the location visited, or alternatively the information may be made available for insertion into a loose-leaf folder.

When a traveller is at a destination which is shown on the map, which may for example be a street plan, there is then a problem for the traveller of locating his position on the map and orienting the map. To do this it has previously been necessary to carry a compass for use in association with the map. Compasses however tend to be bulky and expensive.

It is an aim of certain embodiments of the invention to at least partially mitigate these difficulties.

The traveller also has a number of other possible requirements. One of these is to have readily to hand a calculating device, for example a device dedicated to currency conversion. Alternatively, the traveller may need a writing implement, such as a pen or pencil for taking notes.

Embodiments of the present invention are aimed at meeting these needs.

According to one aspect of the present invention there is provided a spine assembly for a book cover, loose-leaf folder and the like, the assembly comprising a spine member and an associated device, the spine member having two edges, the two edges having connecting means of connecting two cover members of the book cover, folder or the like, the spine member and associated device having securing means for integrally securing the associated device and the spine member.

In a preferred embodiment the securing means comprises a hinge.

Conveniently the spine member further comprises a housing portion for removably housing a further associated device and an engagement means of the associated device for engaging the housing portion.

Conveniently the engagement means comprise opposing projections from an outer periphery of the further device.

Advantageously at least one of the housing portion and the further device is tapered to secure the further device in the housing portion.

In another embodiment, the associated device further comprises an actuating portion, the actuating portion being movable with respect to the spine member for actuating the associated device.

According to a second aspect of the present invention there is provided a book cover comprising the spine assembly of the first aspect of the invention.

According to a third aspect of the present invention there is provided a loose-leaf folder comprising the spine assembly of the first aspect of the invention, and cover members of the loose-leaf folder secured to the spine member at the said edges of the spine member.

According to a fourth aspect of the invention there is provided a book comprising a spine assembly of the first aspect and secured thereto cover members of the book, the book further comprising a plurality of pages.

In one embodiment the pages are secured together to form a page assembly and the-page assembly is secured to one of the cover members.

Where the securing means comprises a hinge, the associated device and the hinge may be disposed such that when the book is open the associated device can be used in association with the open pages of the book.

Preferably the pages include a map.

Advantageously the pages include a foldable product of the type disclosed in our patent Application 0119809.2.

In one embodiment the associated device comprises a compass.

In another embodiment the associated device comprises a calculating device.

Preferably the calculating device comprises a currency converter.

In a further embodiment the spine member incorporates an attack alarm.

In yet another embodiment the associated device comprises a torch.

In yet another embodiment the associated device includes a lipstick.

In yet a further embodiment, the associated device comprises a writing implement.

According to yet another aspect of the invention there is provided a book comprising pages and a cover, the cover having a spine, and the spine comprising a spine member, a display device and a pivotal attachment between the display device and the spine member, the spine member carrying the pages of the book, and the pivotal attachment being such that the display device is pivotable about the pivotal attachment between a first position in which the display can be seen when the pages of the book are open and a second position in which the display device is substantially aligned with the spine member.

Preferably the book is a guide book, and the pages comprise at least one map.

Preferably again the map is embodied as a foldable product of the type disclosed in our patent Application 0119809.2.

Advantageously the display device comprises a compass.

Preferably, each map is disposed in the guide book to display a selected geographic orientation in alignment with the compass in its first position.

Conveniently at least one further-device releasably engages the spine member.

The further device may for instance be a pen, a pencil, or a penlight.

Exemplary embodiments of the invention will now be described with reference to the accompanying drawings in which.

In the various figures like reference numerals refer to like parts.

Figure 1:
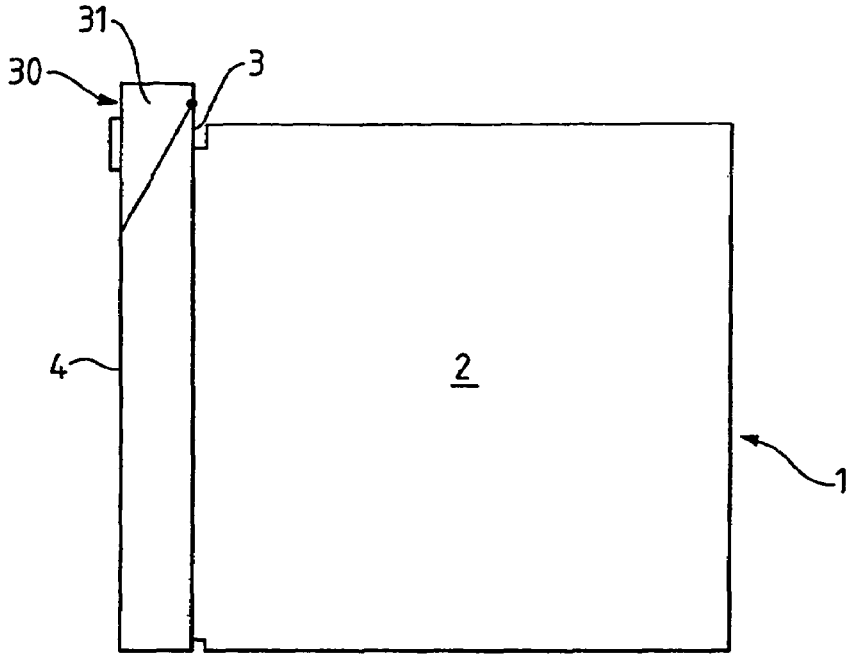
FIG. 1 shows a planned view of a guide book incorporating an embodiment of the spine assembly in accordance with the present invention.

Referring first to FIG. 1, a book 1 consists of a pair of cover boards 2 connected via a hinge portion 3 to a substantially rigid spine member 4.

Figure 3:
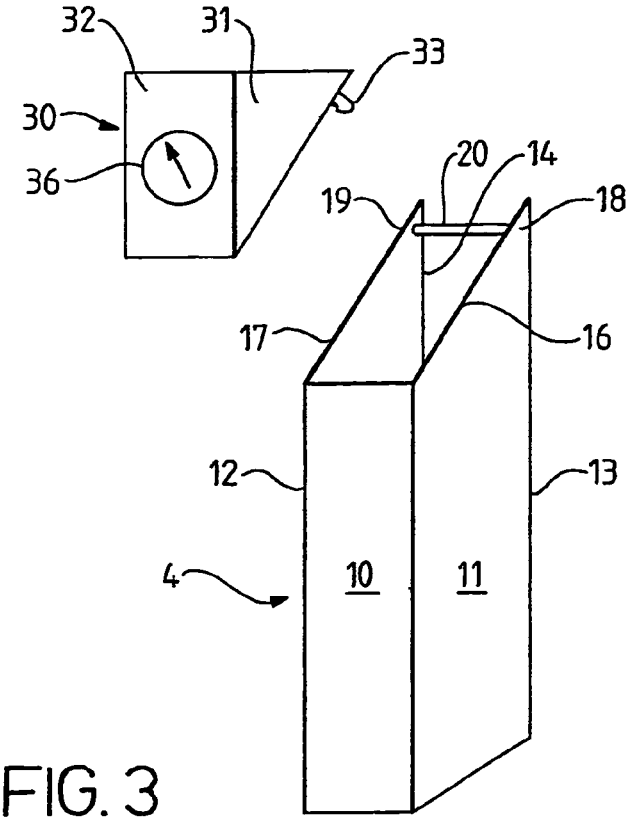
FIG. 3 is a partial perspective view of the spine assembly of FIGS. 1 and 2.

The spine member 4 may be more clearly seen in FIG. 3.

Referring now to FIG. 3 the spine member is of plastics and has the form of a channel. The spine member has a base portion 10 having two opposing edges and, projecting outwardly from the edges, two substantially parallel planar side wall portions 11, 12. The base wall 10 is generally planar and the side wall portions 11, 12 extend to distal edge regions 13, 14 which are substantially parallel to the base wall 10.

At one end of the spine member 4, the lower end as shown in FIG. 3, the side wall portions 11, 12 have edges which are perpendicular to the edge of the base wall 10. At the other end the edges 13, 14 of the side wall portions 11, 12 extend beyond the end of the base wall 10 so that the top, as shown, of the spine member has edges 16, 17 which,are generally mutually parallel and extend to apex points 18, 19 where they form an angle of around 30° to the edges 13, 14 of the side wall. Between the apex regions 18, 19 there extends a circular pin portion 20.

Referring again to FIG. 1 it will be seen that the tapered upper end of the spine assembly has a complementarily formed member 30 which has right-angle triangle formed side walls 31.

Referring again to FIG. 3 the complementary member 30 has a front face 32 which corresponds to the base wall 10 of the spine member 4 and the opposed side walls 31 have ears 33 which engage with and attach to the hinge pin 20.

The front face 32 typically includes a display device such as compass 36.

Figure 2:
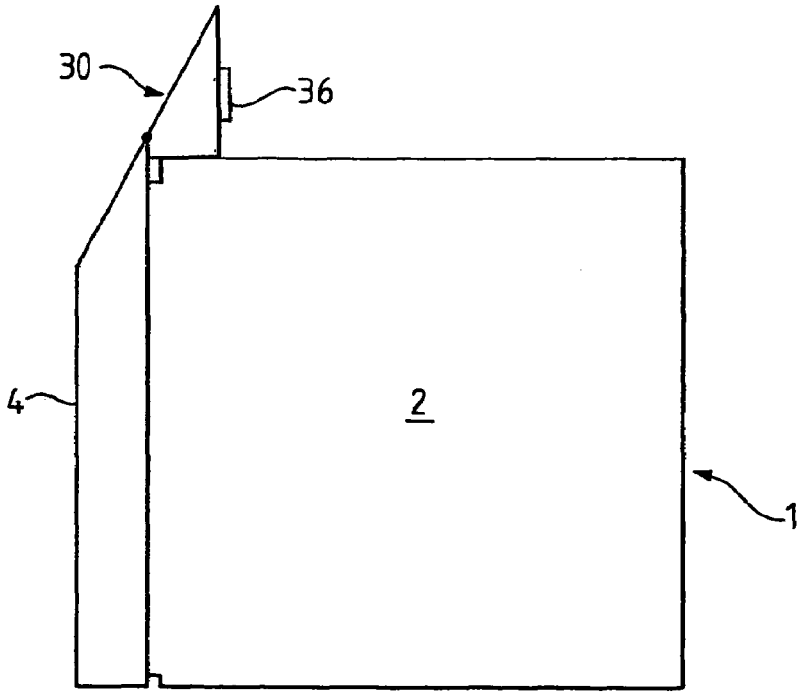
FIG. 2 shows the device of FIG. 1, with a compass deployed in a position for use with the book open.

Referring to FIG. 2 the complementary device 30 of FIG. 1 is pivotable about the hinge pin 20 into a second orientation shown in FIG. 2. It will be seen that in this orientation the book may be opened and maps, plans or the like may be scrutinised while maintaining in view the display device, shown as compass 36. This allows the traveller to correctly orient the map and more easily and readily find his position and the direction that he needs to travel.

In a preferred embodiment the book 1 contains maps or plans of the so-called "popout map" type similar to those disclosed in our patent Application 01198089.2.

The book may have the maps secured in a folder and the folder attached to one of the cover boards 2 while the other cover board 2 (not shown) carries a note pad for making notes.

Other display devices may be provided, for example the compass 36 may be replaced by a time display or more preferably may be supplemented by a time display showing local time.

Figure 4:
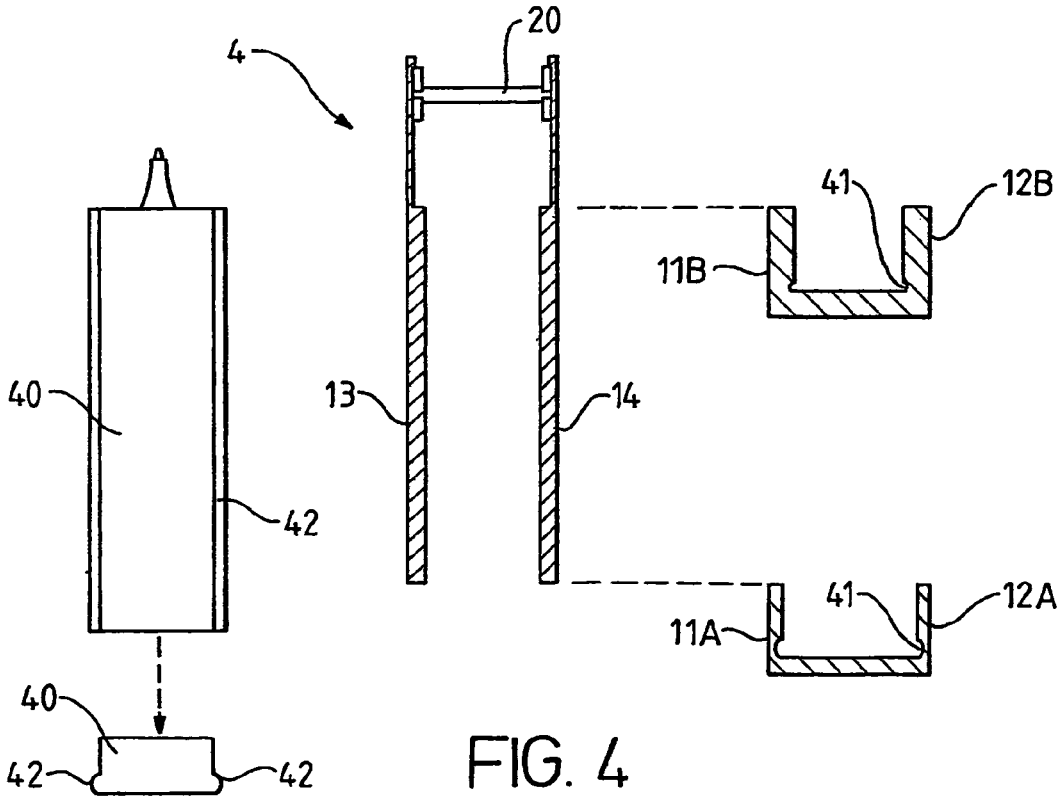
FIG. 4 shows a rear view of the spine assembly of FIG. 3 together with cross-sectional views through the spine assembly, and a pen for interlocking engagement with the spine assembly.

Referring now to FIG. 4, the spine member 4 may be shaped so as to carry a pen or similar device. Referring now to FIG. 4 the side walls 11, 12 of the spine assembly 4 are formed so as to taper upwardly in thickness from the lower end as shown to the upper end. Thus, the thickness 11A, 12A at the open end of the spine member is less than that of a thickened region of the walls 11B, 12B near to the hinge pin 20. The walls may be undercut so as to have opposed engagement slots 41 so as to engage a suitably-formed pen 40 having counterpart projections 42 along its opposing sides.

Figure 5:
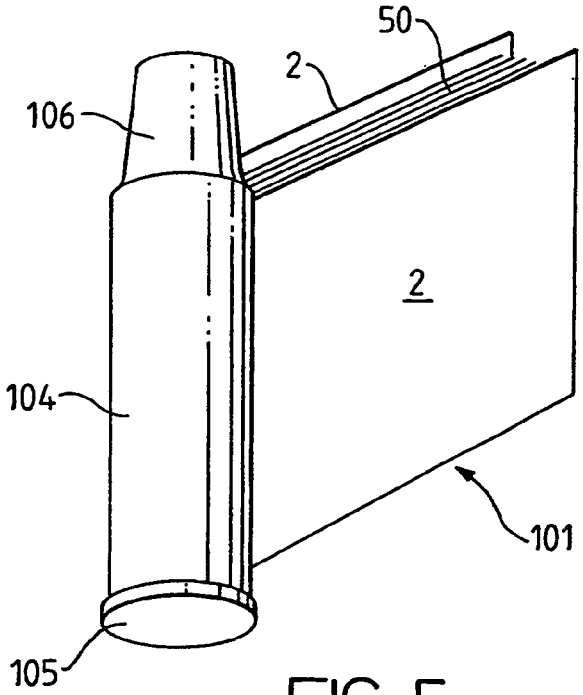
FIG. 5 shows a second embodiment of a book having a spine assembly in accordance with the present invention.

Referring now to FIG. 5 a second embodiment of the invention will now be described.

Referring to FIG. 5 a book 101 has opposing cover boards 2 and disposed there between pages 50. The cover boards are secured to a generally tubular spine assembly 104 which, at one end thereof has an actuating ring 105. The actuating ring operates in known fashion on a lipstick 106 so as to allow the lipstick to be inwardly or outwardly moved of the spine member 104.

It will of course be understood by those skilled in the art that the lipstick shown in FIG. 5 could be incorporated in to the spine assembly 4 shown in FIGS. 1-3 so as to also provide the display device.

Figure 6:
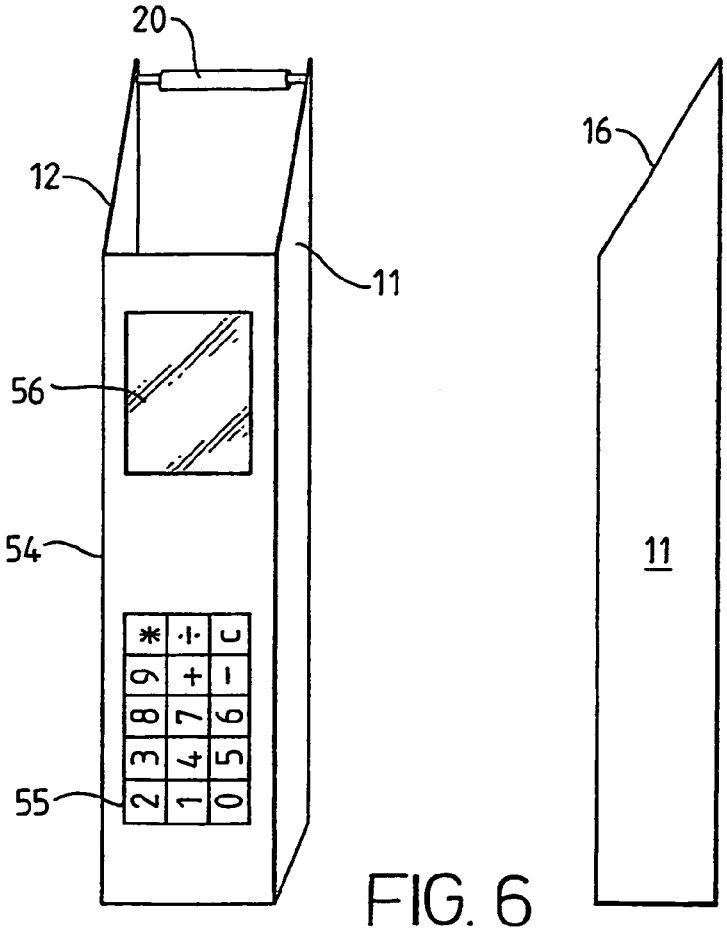
FIG. 6 shows perspective and side views of a modification of the spine assembly of FIG. 3.

Referring now to FIG. 6, a modification of the spine member 4 of FIGS. 1-3 will now be described. In this spine member 54 the bottom wall 10 described with respect of FIG. 3 forms a keypad 55 and display 56 for a calculating device which is integrated in the spine member 54.

The keypad may be operated by a pen or pencil or may be operated by a stylus carried in similar fashion to the pen shown in FIG. 4.

Figure 7:
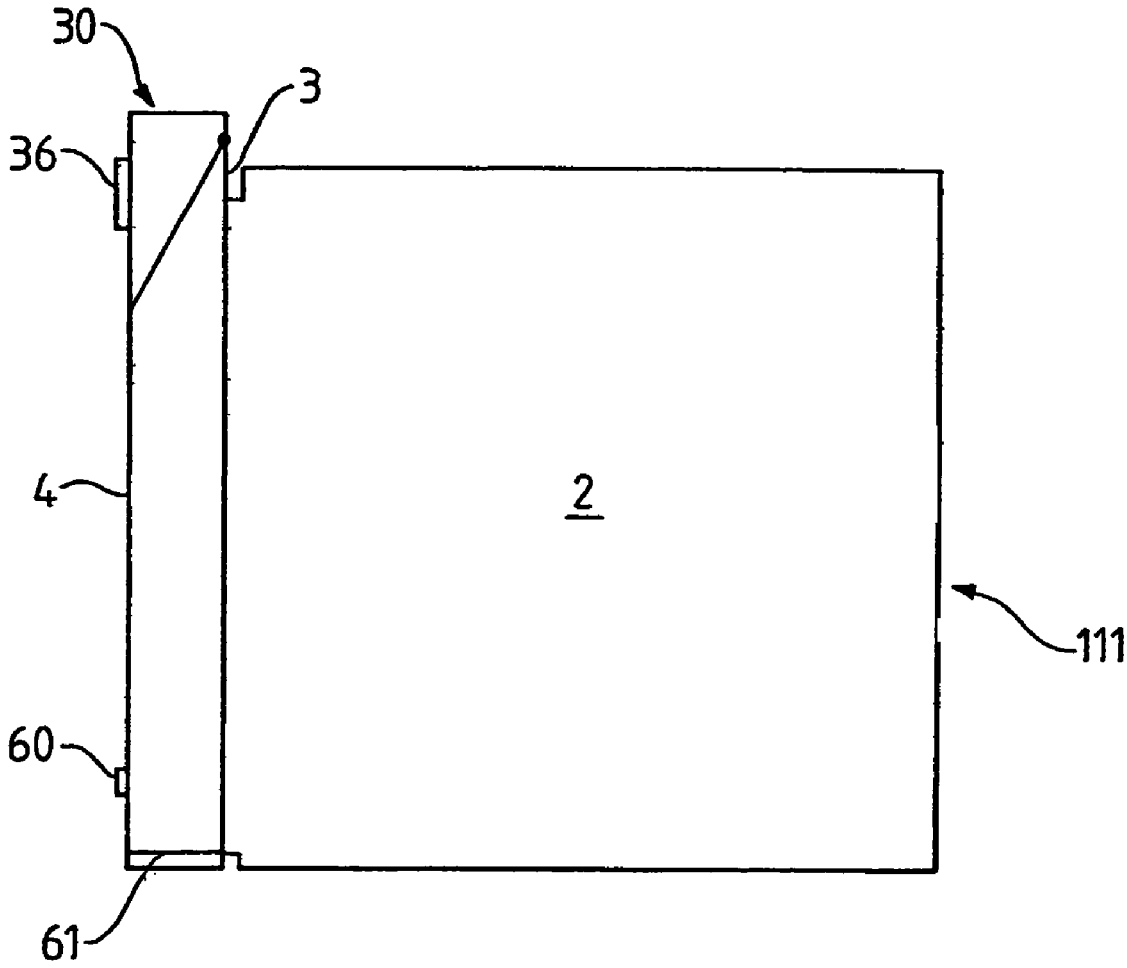
FIG. 7 shows a modification of the book shown in FIG. 1.

Referring now to FIG. 7 a further embodiment will now be described.

In this further embodiment of a book 111 the spine member 4 is modified so as to have a push button or actuating button 60 projecting outwardly therefrom. In the embodiment shown in FIG. 7 the push button is on the base wall of the spine member but it will be understood that it could be replaced by one or more push buttons on the side walls or by a slide switch. In the embodiment shown in FIG. 7 the push button 60 operates a torch having a bulb within the spine assembly and a lens 61 at one end thereof. As seen in FIG. 7, the compass 36 remains at the upper end of the spine member and remains pivotable so as to be capable of being viewed while the book is open.

Although the torch is shown in FIG. 1 as being integral with the spine member it will be understood by those skilled in the art that a releasably secured torch or penlight could alternatively be supplied.

It will also be clear to those skilled in the art that the spine member may be modified to integrally support a number of other actuatable devices such as for example an attack alarm or a chemical anti-attack spray. It will also be clear to those skilled in the art that the spine or cover of the book may contain a readable medium such as a computer readable medium or a mini disk which contains further information on the subject matter of the book.

Although the book has been described as a travel or guide book it will be clear to those skilled in the art that other books could be substituted and that the invention is equally applicable to loose-leaf folders.

The described embodiments are intended to be exemplary and the invention is not limited to the features described in the embodiments but instead extends to the full width of the appended claims.

The invention claimed is:

1. A spine assembly for a book cover or loose-leaf folder, the assembly comprising a spine member and an associated device, the spine member having two edges, the two edges having connecting means for connecting two cover members of the book cover or folder, the spine member being secured to the associated device;

wherein the spine member further comprises a housing portion for removably housing a further associated device and an engagement means of the associated device for engaging the housing portion, wherein the engagement means comprises opposing projections from an outer periphery of the further device.

2. The spine assembly of claim 1, including securing means comprising a hinge for securing the associated device and the spine member.

3. A book comprising pages and a cover, the cover having a spine, and the spine comprising a spine member, a display device and a pivotal attachment between the display device and the spine member, the spine member carrying the pages of the book, and the pivotal attachment being such that the display device is pivotable about the pivotal attachment between a first position in which the display device can be seen when the pages of the book are open and a second position in which the display device is substantially aligned with the spine member.

4. The book of claim 3, wherein the book is a guide book, and the pages comprise at least one map.

5. A spine assembly for a book cover or loose-leaf folder, the assembly comprising a spine member and an associated device, the spine member having two edges, the two edges having connecting means for connecting two cover members of the book cover or folder, the spine member being secured to the associated device;

wherein the spine member further comprises a housing portion for removably housing a further associated device and an engagement means of the associated device for engaging the housing portion;

wherein at least one of the housing portion and the further device is tapered to secure the further device in the housing portion.

6. The spine assembly as claimed in claim 1, wherein the associated device further comprises an actuating portion, the actuating portion being movable with respect to the spine member for actuating the associated device.

7. A book cover comprising the spine assembly as claimed in claim 1.

8. A loose-leaf folder comprising the spine assembly as claimed in claim 1 in combination with cover members of the loose-leaf folder secured to the spine member at the said edges of the spine member.

9. A book comprising a spine assembly as claimed in claim 1, and secured thereto cover members of the book, the book further comprising a plurality of pages.

10. The book as claimed in claim 9, wherein the pages are secured together to form a page assembly and the page assembly is secured to at least one of the cover members.

11. A book comprising a spine assembly as claimed in claim 2, wherein the associated device and the hinge may be disposed such that when the book is open, the associated device can be used in association with the open pages of the book.

12. A book as claimed in claim 9, wherein the pages include a map.

13. The book as claimed in claim 3, wherein the display device comprises a compass.

14. The book as claimed in claim 13, wherein each map is disposed in the guide book to display a selected geographic orientation in alignment with the compass in its first position.

15. The book as claimed in claim 3, wherein at least one further device releasably engages the spine member.

16. The book as claimed in claim 15, wherein the further device comprises a writing implement.

17. The book as claimed in claim 15, wherein the further device comprises a penlight.

* * * * *